United States Patent [19]

Cabrol

[11] 4,026,206

[45] May 31, 1977

[54] PRESSING DEVICE WORKING IN CONTINUOUS OPERATION

[75] Inventor: Yves Cabrol, Aix en Provence, France

[73] Assignee: Societe d'Exploitation des ets Coq, Aix en Provence, France

[22] Filed: May 22, 1975

[21] Appl. No.: 577,869

[30] Foreign Application Priority Data

May 22, 1974 France ..... 74.17898

[52] U.S. Cl. ..... 100/117; 100/145; 74/129

[51] Int. Cl.[2] ..... B30B 9/12

[58] Field of Search ..... 100/117, 145–150; 74/129, 142

[56] References Cited

UNITED STATES PATENTS

| | | | |
|---|---|---|---|
| 2,817,287 | 12/1957 | Onarheim et al. | 100/117 X |
| 2,874,544 | 2/1959 | Switzer | 74/129 X |
| 2,912,923 | 11/1959 | Jung | 100/117 |
| 3,455,176 | 7/1969 | Dunn et al. | 74/129 |
| 3,535,945 | 10/1970 | Bowman | 74/129 |

FOREIGN PATENTS OR APPLICATIONS

| | | | |
|---|---|---|---|
| 1,139,939 | 1/1969 | United Kingdom | 74/129 |

*Primary Examiner*—Peter Feldman

*Attorney, Agent, or Firm*—Mason, Kolehmainen, Rathburn & Wyss

[57] ABSTRACT a. The invention relates to a pressing-device working in continuous.

b. The pressing-device according to the invention comprises a motor element consisting of a double-effect jack fed with fluid under pressure, while the worm-screw is, inside the cylinder, integral with a disc provided with fingers or notches equally distributed along the peripheral thereof, the rod of the jack co-operating in succession with the fingers so as to set them into motion.

3 Claims, 1 Drawing Figure

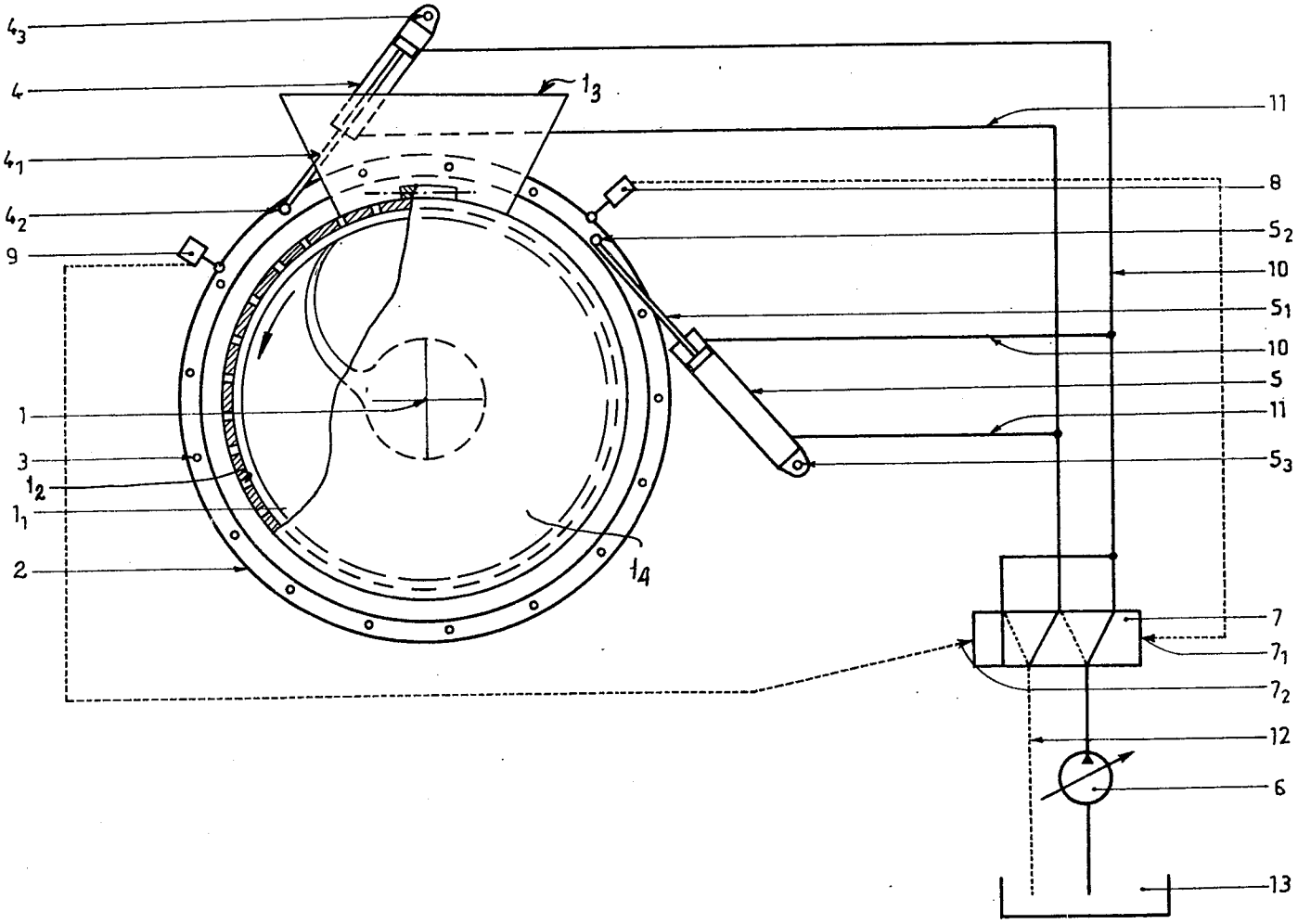
11
8
$5_2$
10
$5_1$
10
5
11
$5_3$
7
$7_1$
$7_2$
12
6
13
$1_3$
$1_4$
$4_3$
4
$4_1$
$4_2$
9
1
3
$1_2$
$1_1$
2

PRESSING DEVICE WORKING IN CONTINUOUS OPERATION

The invention relates to a pressing device working in continuous operation, in which theArchimedean screw which ensures the pressure of the fruit to be pressed, is slowly set to motion, for example from 0.5 to 1 turn per minute.

The pressing-devices working in continuous operation already known are set into motion, either by means of an electric motor, or a hydraulic pump.

Where the pressing-device is set into motion by means of an electric motor, the latter entails a speed changer with belts and a reducing-gear which then drives the screw.

However, generally the electric motor turns at a speed of 1500 turns per minute, and the strong reduction of the speed requires a ratio reducing means of 1/1500 or over. Besides, the very strong couple which must be originated to set the screw into motion requires a series of very strong sets of gears.

Furthermore, it is to be noted that such a driving means shows a bad mechanical output, in view of the loss of power further to the great speed reduction, and of the great weakness of the limit of the change in speed (form 1 to 4 for great powers). Furthermore, such a pressing-device is costly, particularly in view of the speed reducing means which must be achieved.

Also, it is known to replace the electric motor by a hydraulic pump having a changeable outflow, which sets into motion a slow or rapid hydraulic motor and, in such a case, the motion is transmitted to the screw by means of a reducing means which makes it possible to obtain the slow speeds sought for.

Such a mode of embodiment makes it possible to obtain low speeds with a continuous change in speed from 0 to 2 or 3 turns per minute, but also shows a bad mechanical output, in view of the great ratio of reduction. In addition, the costing price is much more higher than that of the preceding solution (about twice), which prevents this solution from being marketed.

The purpose of the present invention is especially to remedy such drawbacks, and relates to this end to a pressing-device working in continuous operation which comprises a motor setting into rotation a worm-screw which rotates inside a perforated cylinder, said cylinder being provided at the vicinity of one of its ends with an aperture for the introduction of the fruits to be pressed and, at its other end, with a pressure door against which the fruits apply for the extraction of the juice therof, a pressing-device in which there is a motor consisting of at least a double-effect jack fed with fluid under pressure, whilst the worm-screw is, outside the cylinder, integral with a disc carrying fingers or notches equally distributed along its peripheral, the rod of the jack being co-operating in succession with the fingers or notches so as to set them in motion.

According to another characteristic of the invention, the reversed working out of the double-effect jack is obtained through a fluid distributing device inserted in the feeding circuit of the jack, said distributing means being itself operated by a contact means co-operating with the disc provided with fingers or notches.

According to another characteristic of the invention, the contact means consists of an electric or a hydraulic contactor.

The invention is depicted by way of non-limitative example in the sole drawing attached therein, which is a diagrammatical view of a pressing-device, especially showing the motor which sets the Archimedean screw into rotation.

Thereby, the purpose of the present invention is to provide a pressing-device working in continuous operation, likely to be of a low costing price and making it possible to obtain very slow speeds of rotation, said rotation being such that it may be stopped or slowed down whilst the pressure of the fruits inside the cylinder decreases further to a discharge of the juice.

This embodiment then shows a good mechanical output, its costing price is rather low, and it makes it possible to improve the quality of the juice thus extracted.

As shown in the attached drawing, the Archimedean screw 1 used for pressing the juice is diagrammatically shown with its axis 1, said screw turning inside a perforated cylinder 2 through the perforations of which the juice discharges.

As it is already known, the perforated cylinder comprises, at the vicinity of one of its ends, an aperture 3 for introducing the fruits therein, whilst the other end therof carries a pressure door 4 against which a substantially uniform pressure is applied by means of the jack. For getting the juice extracted, the screw presses the fruits against said door, whilst the latter makes it possible to extract the dry pulp, depending on its pressure against the door.

According to the invention, the Archimedean screw is, inside the cylinder, integral with a disc provided with fingers or notches equally distributed.

According to the example shown in the sole drawing attached therein, the disc is in fact consisting of a ring 2 which is secured on to the collar of the screw 1.

The ring 2 carries fingers or notches 3 equally distributed, with which the rods $4_1$, $5_1$ of two double-effect jacks 4 and 5, cooperate in succession and alternatively.

To this end, the ends of the rods $4_1$ and $5_1$ of the jacks 4 and 5 are provided with hooks or abutments $4_2$, $5_2$, preferably hinged, likely to be brought into contact with the fingers 3 when said rods are moving.

Also, as shown in the drawing attached therein, said jacks 4 and 5 are mounted pivoting at their rear end, by means of axes $4_3$, $5_3$, said pivoting fitting of the jacks making it possible that the ends of the rods $4_2$, $5_2$ move aside in relation to the fingers 3 when the rods $4_1$, $5_1$ enter the cylinders of the jacks or, on the contrary, to move behind said fingers 3 when the rods $4_1$, $5_1$ get out.

Feeding of the fluid under pressure of the jacks 4 and 5 is performed by a hydraulic pump 6, whose delivery may continuously be adjusted.

Both noses $7_1$ and $7_2$ of the distributor 7 are operated by contactors, preferably electric or hydraulic contactors 8 and 9, each co-operating with fingers 3 themselves, or with driving abutments provided independent on the ring 2 and arranged in such a way that each contactor 8 and 9 ensures the reverse of the state of the distributor 7 when the rod of the corresponding jack, 5 and 4 respectively, has reached the end of its stroke outside the cylinder of the jack.

According to this installation, the feeding circuits of the jacks are then reversed by the ducts 10 and 11, in such a way that, when one of the rods of a jack leaves its cylinder, the rod of the other cylinder enters its cylinder, so that the Archimedean screw is set alternately into rotation by said jacks 4 and 5.

Also, a circuit 12 is provided in the circuit for the fluid of the motor in a vessel 13

Thus, the pressing-device achieved is a pressing device working continuously, whose adjustable speed may be slow; but it can also be noted that, when the rod of each jack leaves its cylinder, it exerts a pressure on to the fruits, which is weaker at the beginning of the motion in order to regularly increase till the rod of said cylinder is totally out. Then, at that time, during the time necessary to the rod for returning inside its cylinder, or prior to the pressure of the rod of the other cylinder on to another finger 3, the pressure of the fruit inside the pressing-device decreases further to the discharge of the juice which makes it possible, not only to lower the power of the motor required for operating the pressing-device, but also to improve the quality of the juice thus extracted.

Of course the invention is not limited to the mode of embodiment described and represented hereabove, from which other modes and methods of embodiment can be provided without, thereby, departing from the scope of the invention.

What we claim is:

1. A pressing device working continuously, comprising a motor setting a worm-screw into rotation inside a perforated cylinder, said cylinder being provided, at the vicinity of one of its ends, with an aperture for introducing the fruits to be pressed therein, and at its other end with a pressure door against which the fruits apply to extract the juice therof, a pressing-device wherein the motor element consists of at least a double-effect jack including a rod, fed with fluid under pressure, whilst the worm-screw is, inside the cylinder, integral with a disc provided with fingers or notches equally distributed along the peripheral thereof, the rod of the jack co-operating in succession with the fingers or notches so as to set them into motion.

2. A pressing device according to Claim 1, wherein the working out of the double-effect jack is reversed by means of a fluid distributor inserted in the feeding circuit of the jack, said fluid distributor being controlled by contact means and said means cooperating with the disc which carries fingers or notches.

3. A pressing-device according to claim 1 wherein the motor element comprises two double-effect jacks which co-operate alternately with the fingers of the disc.

* * * * *